US009407009B2

(12) United States Patent
Mahara

(10) Patent No.: US 9,407,009 B2
(45) Date of Patent: Aug. 2, 2016

(54) ANTENNA COIL DEVICE

(71) Applicant: SUMIDA CORPORATION, Tokyo (JP)

(72) Inventor: Shigeru Mahara, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 140 days.

(21) Appl. No.: 14/287,577

(22) Filed: May 27, 2014

(65) Prior Publication Data

US 2014/0361949 A1 Dec. 11, 2014

(30) Foreign Application Priority Data

Jun. 6, 2013 (JP) ..... 2013-119800

(51) Int. Cl.

| | |
|---|---|
| ***H01Q 7/00*** | (2006.01) |
| ***H01Q 7/06*** | (2006.01) |
| ***H01Q 7/08*** | (2006.01) |
| ***H01Q 1/32*** | (2006.01) |
| ***H01Q 1/12*** | (2006.01) |
| ***H01Q 1/36*** | (2006.01) |
| ***H01Q 11/08*** | (2006.01) |
| *H01R 13/506* | (2006.01) |

(52) U.S. Cl.

CPC ..... *H01Q 7/00* (2013.01); *H01Q 1/1207* (2013.01); *H01Q 1/3233* (2013.01); *H01Q 1/3241* (2013.01); *H01Q 1/362* (2013.01); *H01Q 11/08* (2013.01); *H01R 13/506* (2013.01)

(58) Field of Classification Search

CPC ..... H01Q 7/00; H01Q 7/06; H01Q 7/08; H01Q 1/3233; H01Q 1/3241

USPC ..... 343/787, 788, 713

See application file for complete search history.

(56) References Cited

U.S. PATENT DOCUMENTS

| | | | | |
|---|---|---|---|---|
| 7,095,381 | B2 * | 8/2006 | Kimura | H01Q 1/3241 343/788 |
| 7,427,963 | B2 * | 9/2008 | Moriya | H01Q 7/08 343/713 |
| 8,358,250 | B2 * | 1/2013 | Sako | H01Q 7/08 343/713 |
| 8,420,188 | B2 | 4/2013 | Kawashima et al. | |
| 8,552,827 | B2 * | 10/2013 | Kudo | H01F 27/34 336/199 |
| 2011/0215987 | A1 | 9/2011 | Ohara et al. | |

FOREIGN PATENT DOCUMENTS

| | | |
|---|---|---|
| JP | 2009-152784 A | 7/2009 |
| JP | 2011-205616 A | 10/2011 |

* cited by examiner

*Primary Examiner* — Hoang V Nguyen
(74) *Attorney, Agent, or Firm* — Cantor Colburn LLP

(57) ABSTRACT

An antenna coil device including: a connector unit mounted with a connector of an external circuit detachably by being plugged-in; and a base unit provided with an antenna body including a coil, in which the connector unit and the base unit are constituted by separate members and are used by being combined integrally each other, wherein for the connector unit and the base unit, there are formed a connector fitting portion and a base fitting portion which are formed with a concave and a convex in a direction intersecting with respect to the plug-in direction of the connector unit, and by fitting the connector fitting portion and the base fitting portion, the connector unit and the base unit are combined in a state in which the antenna body is positioned with respect to the connector unit.

9 Claims, 7 Drawing Sheets

ANTENNA COIL DEVICE

CROSS REFERENCES TO RELATED APPLICATIONS

The present invention contains subject matter related to Japanese Patent Application 2013-119800 filed in the Japanese Patent Office on Jun. 6, 2013, the entire contents of which being incorporated herein by reference.

BACKGROUND OF THE INVENTION

1. Field of the Invention

The present invention relates to an antenna coil device.

2. Description of the Related Art

In recent years, there has been practically used an electronic key system using an antenna coil device which is installed in a vehicle. In the electronic key system, when a driver who possesses the electronic key enters into the communication zone of the system by coming close to the vehicle, communication is carried out between the antenna coil device and the electronic key, a control circuit on the vehicle side, which is connected to this antenna coil device, is driven, and door unlocking, engine activation and the like are allowed. In addition, when the driver possessing the electronic key comes out from the communication zone of the system by going apart from the vehicle, the control circuit on the vehicle side is driven again and door locking is carried out.

In Patent Document 1 (Japanese unexamined patent publication No. 2009-152784) and Patent Document 2 (Japanese unexamined patent publication No. 2011-205616), there are disclosed antenna coil devices of this kind. For the antenna coil device of the Patent Document 1 (Japanese unexamined patent publication No. 2009-152784), a connector unit and a bobbin are integrally formed and a coil is wound around the cylindrical portion of the bobbin. In the inside of the connector unit, a pair of antenna terminals are exposed. The antenna terminals and the coil are connected through a circuit. The connector unit is interlinked with a connector (vehicle side connector) which is an interface of the control circuit on the vehicle side. In the antenna coil device of the Patent Document 1 (Japanese unexamined patent publication No. 2009-152784), a resin-made case is mounted by being fitted at the periphery of the connector and the bobbin.

Here, the shape and the dimension of the connector on the vehicle side are different generally depending on the type of vehicle. In the antenna coil device of the Patent Document 2 (Japanese unexamined patent publication No. 2011-205616), the terminal board (base unit) provided with the antenna body and the connector unit mounted with the connector on the vehicle side are separately formed by separate members. Thus, the antenna body and the base unit are fabricated by a common component and concurrently, by fabricating the connector unit with an individual shape corresponding to the connector on the vehicle side for everyone thereof, there is achieved generalization for the component of the antenna coil device. In the antenna coil device of the Patent Document 2 (Japanese unexamined patent publication No. 2011-205616), the base unit and the connector unit are indirectly combined integrally by inserting the base unit into one opening of a rubber-made annular elastic plug and by inserting the connector unit into the other opening thereof. The antenna terminal protruding from the base unit is exposed in the inside of the connector unit by passing through an elastic plug. The antenna body and the elastic plug are housed in a case. There are formed protrusions circularly in the periphery of the annular elastic plug and by engaging these protrusions with the inside of the case, the elastic plug, the base unit and the connector unit are to be fixed on the case.

SUMMARY OF THE INVENTION

When the operation accuracy of the electronic key system is low, the door will not be unlocked even if the driver possessing the electronic key comes close to the vehicle, and an inconvenience occurs for the driver. In addition, in a case in which the door will not be locked even if the driver possessing the electronic key gets off and goes apart from the vehicle, there will occur a problem in the vehicle security. The accuracy reduction in the operation of the electronic key system occurs by various causes, in which defective electrical continuity between the connector and the antenna body on the vehicle side becomes one cause thereof.

In the antenna coil device of the Patent Document 2 (Japanese unexamined patent publication No. 2011-205616), the base unit and the connector unit are combined through a rubber-made elastic plug. When engaging the elastic plug on the inside of the case, the elastic plug is pressed from the periphery onto the case and is distorted. For this reason, the antenna terminal inserted through the elastic plug by protruding from the base unit is displaced relatively with respect to the connector unit and the connector on the vehicle side. As a result thereof, there is fear that there may occur defective electrical continuity between the connector and the antenna body on vehicle side.

The present invention was invented in view of the problem as mentioned above and is to provide an antenna coil device by which it is possible to realize generalization of the base unit provided with the antenna body and by which it is possible to realize stable electric-conduction between the connector of the external circuit (for example, connector on the vehicle side) and the antenna body.

According to the present invention, there is provided an antenna coil device including: a connector unit mounted with a connector of an external circuit detachably by being plugged-in; and a base unit provided with an antenna body including a coil, in which the connector unit and the base unit are constituted by separate members and are used by being combined integrally each other, wherein for the connector unit and the base unit, there are formed a connector fitting portion and a base fitting portion which are formed with a concave and a convex in a direction intersecting with respect to the plug-in direction of the connector unit, and by fitting the connector fitting portion and the base fitting portion, the connector unit and the base unit are combined in a state in which the antenna body is positioned with respect to the connector unit.

According to an antenna coil device of the present invention, the antenna body is positioned with respect to the connector unit by fitting the connector fitting portion and the base fitting portion which are constituted by members separated from each other. Consequently, according to the antenna coil device of the present invention, it is possible to realize generalization of the base unit provided with the antenna body and concurrently, it is possible to realize stable electric-conduction between the connector of the external circuit and the antenna body.

DESCRIPTION OF THE PREFERRED EMBODIMENTS

Figure 1A:
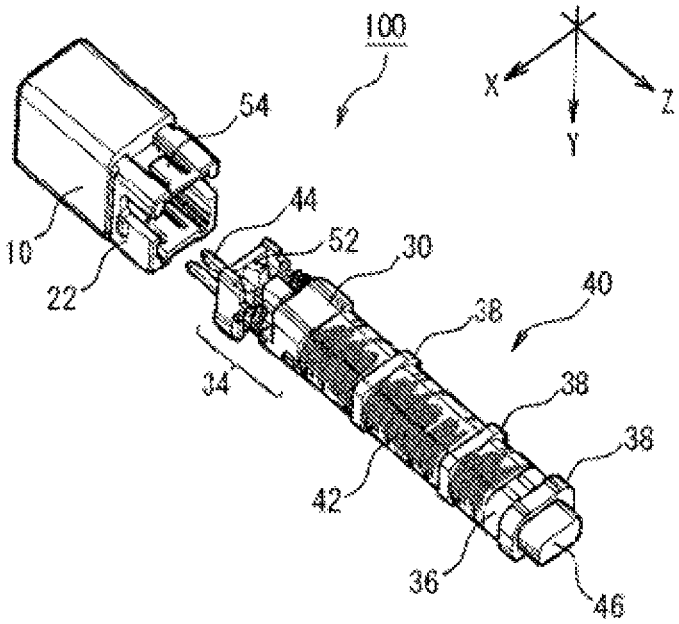
FIG. 1A is an exploded perspective view showing one example of an antenna coil device of the present invention.

Hereinafter, exemplified embodiments of the present invention will be explained based on the drawings. It should be noted in all the drawings that similar reference numerals are applied to similar constituent elements and repetitive explanations thereof will be omitted arbitrarily.

Figure 1B:
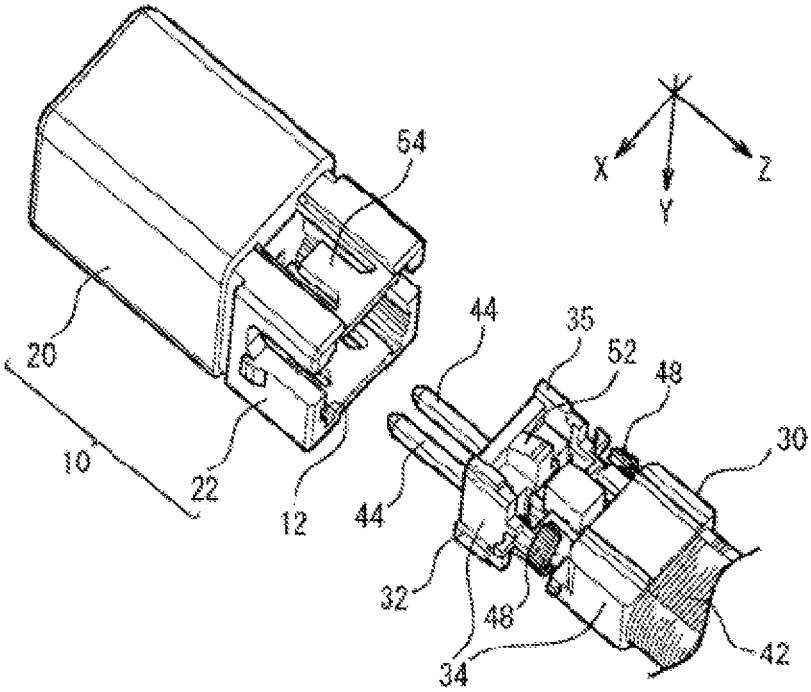
FIG. 1B is a partially enlarged view of FIG. 1A.
Figure 2:
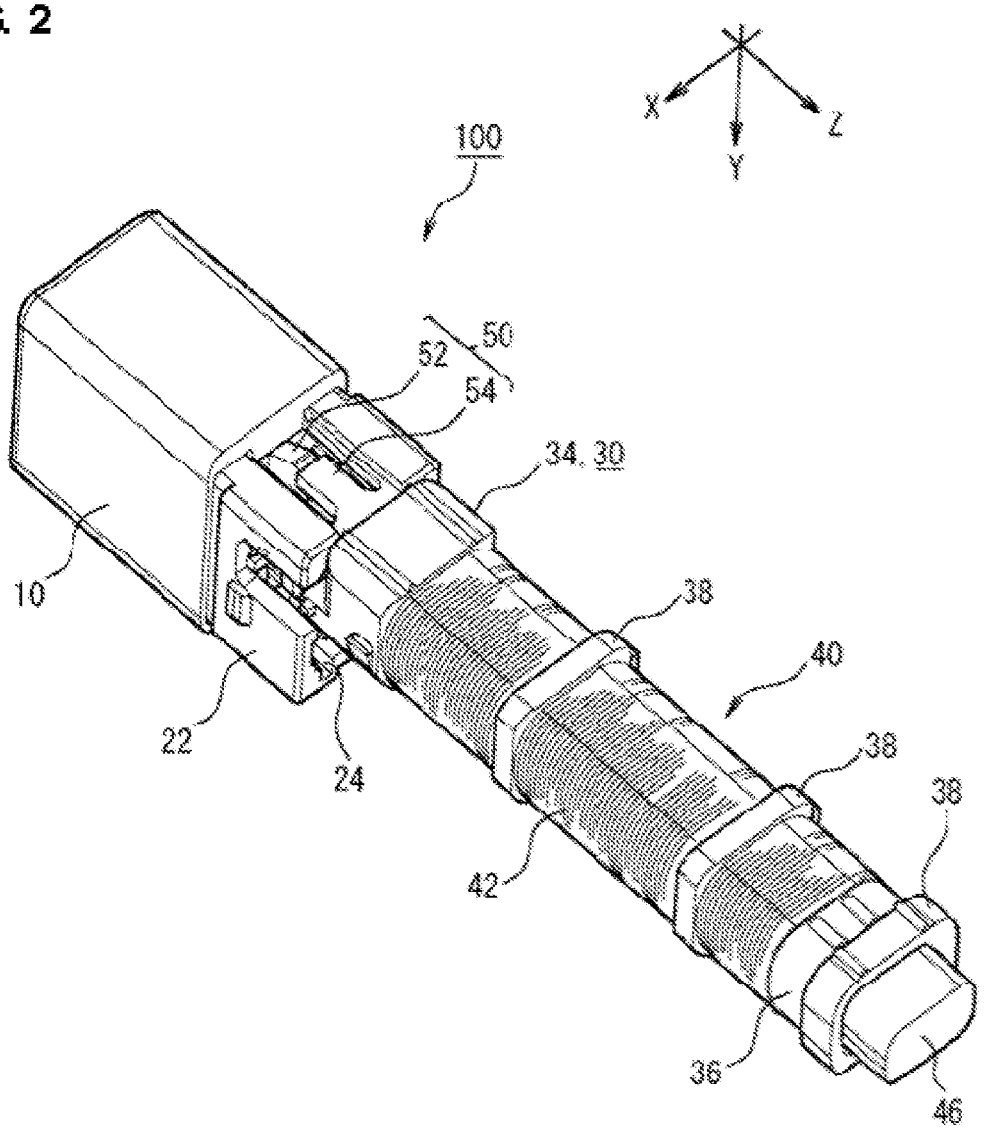
FIG. 2 is a perspective view showing one example of an antenna coil device of the present invention.
Figure 3:
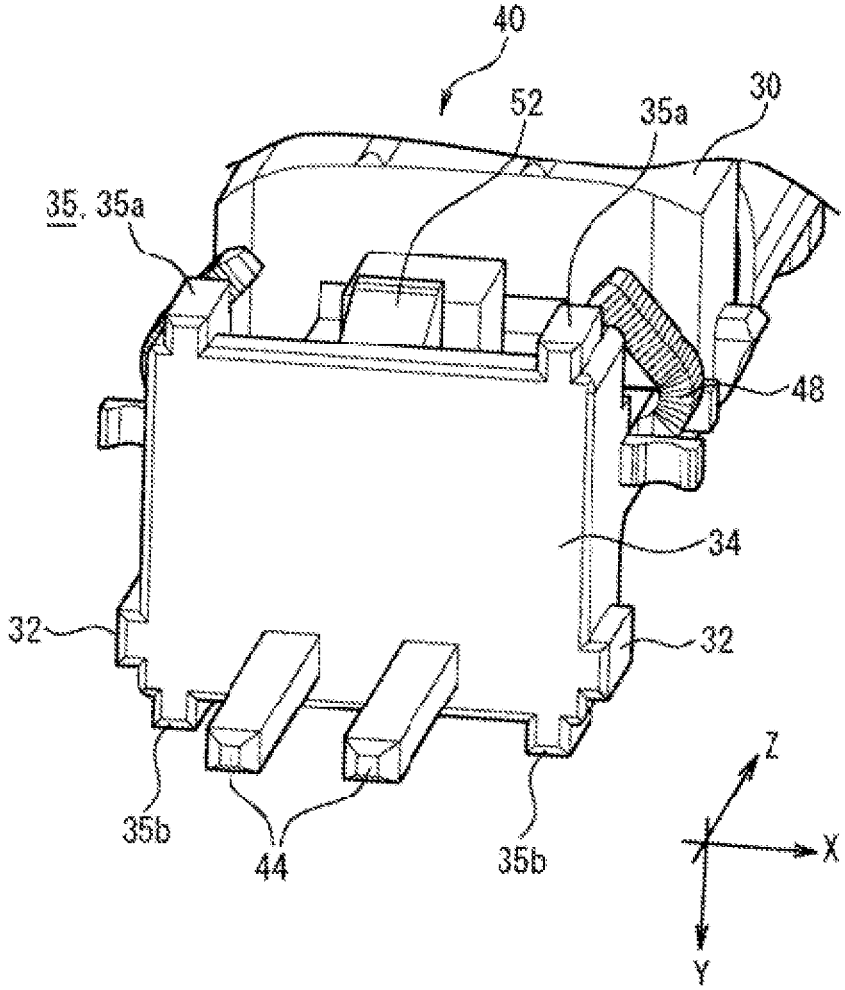
FIG. 3 is a perspective view showing a distal portion of a base unit.
Figure 4:
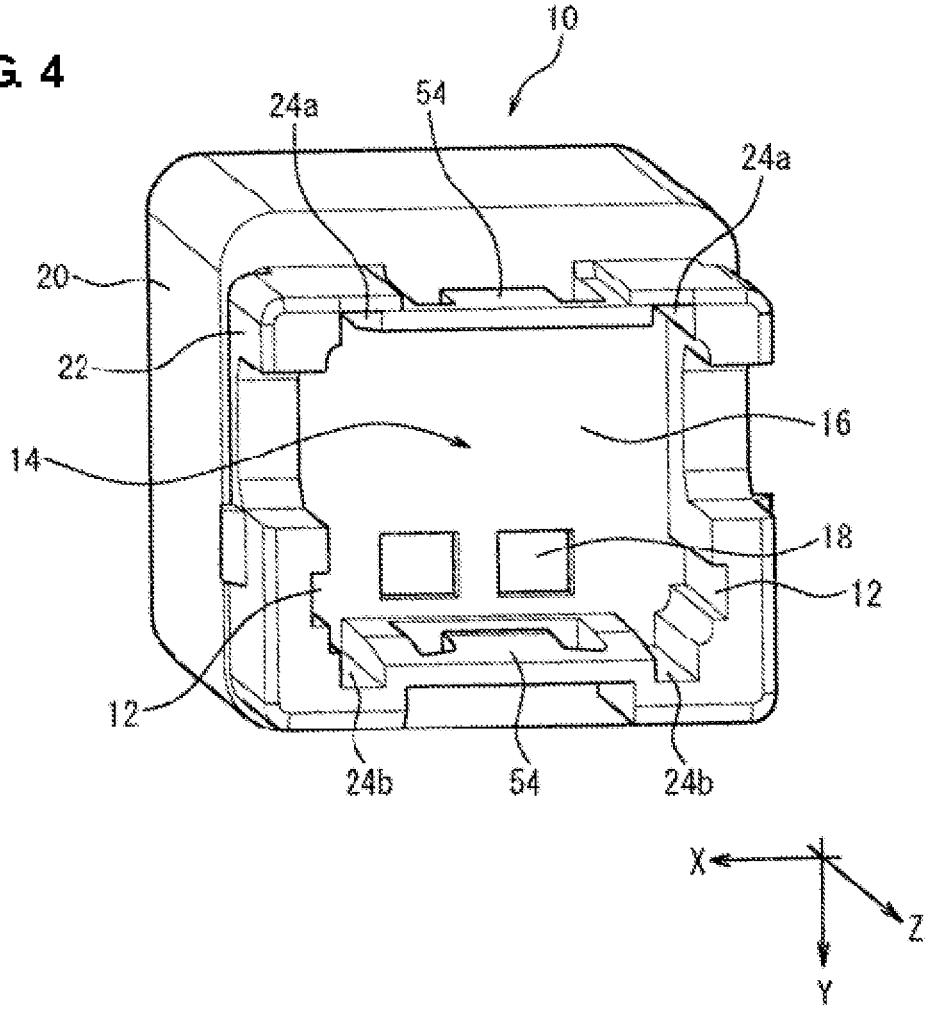
FIG. 4 is a perspective view showing a proximal portion of a connector unit.

FIG. 1A is an exploded perspective view showing an antenna coil device 100 relating to an exemplified embodiment of the present invention. FIG. 1B is a partially enlarged view of FIG. 1A. For a base unit 30, only a portion of on the distal side is illustrated and the illustration of other portions thereof is omitted. FIG. 2 is a perspective view showing the antenna coil device 100 of an exemplified embodiment of the present invention. In FIG. 1 and FIG. 2, the winding-axis direction of a coil 42 of an antenna body 40 is made to be Z-direction, the aligning direction of a pair of antenna terminals 44 is made to be X-direction, and the direction perpendicular to the Z axis and X axis is made to be Y axis. Within the antenna body 40, the side on which a connector unit 10 exists is made to be (−Z)-direction and the direction apart from the connector unit 10 is made to be (+Z)-direction. FIG. 3 is a perspective view showing a distal portion of the base unit 30. FIG. 4 is a perspective view showing a proximal portion of the connector unit 10.

First, there will be explained an outline of the antenna coil device 100. The antenna coil device 100 of this exemplified embodiment includes a connector unit 10 mounted with a connector of an external circuit (not shown) by being plugged-in detachably and a base unit 30 provided with an antenna body 40 which includes a coil 42. The connector unit 10 and the base unit 30 are constituted by separate members and are used by being combined integrally with each other. For the connector unit 10 and the base unit 30, there are formed a connector fitting portion 12 and a base fitting portion 32 which are formed with a concave and a convex respectively toward the intersecting direction with respect to the plug-in direction of the connector unit 10. By fitting the connector fitting portion 12 and the base fitting portion 32, the connector unit 10 and the base unit 30 are combined in a state in which the antenna body 40 is positioned with respect to the connector unit 10.

The state in which the antenna body 40 is positioned with respect to the connector unit 10 means a state in which the position facing to a coupling portion 15 of the connector unit 10 within the antenna body 40, that is, a state in which the relative position between the antenna terminal 44 and the connector unit 10 in this exemplified embodiment is fixed.

Next, there will be explained this exemplified embodiment in detail.

The antenna coil device 100 of this exemplified embodiment is a magnetic field antenna in which the coil 42 is wound around the periphery of a core 46. The core 46 is made of a magnetic material having high magnetic permeability such as ferrite and it is formed in a bar-shape. The coil 42 is an electrical wire coated with insulator on the surface thereof. The antenna coil device 100 of this exemplified embodiment is a bar-antenna and, for example, it can be used as a transmitting antenna device on the vehicle side in the electronic key system of the vehicle.

In FIG. 2, there is illustrated a state in which the connector unit 10 and the base unit 30 are interlinked and the coil 42 is exposed, but the antenna coil device 100 is not limited by this configuration. The antenna coil device 100 may include an exterior resin (not shown) over-molded so as to coat the coil 42 which is wound around the base unit 30.

The antenna body 40 constitutes a resonant circuit formed by a combination of the coil 42, which is wound around the core 46 having an open magnetic-path structure, and a capacitor (not shown) connected in series therewith. The antenna coil device 100 is used by being connected to a connector (not shown) of an external circuit. The connector of the external circuit is inserted into the coupling portion 15 (see FIG. 7) which is a concave portion on the distal side of the connector unit 10 of the antenna coil device 100. The antenna terminal 44 of the antenna body 40 is exposed in the coupling portion 15 by penetrating from the proximal side to the distal side with respect to the connector unit 10 and the external circuit applies an AC current, which corresponds to the resonant frequency of the antenna body 40, to the antenna terminal 44. Thus, the antenna body 40 (antenna coil device 100) generates a magnetic field, propagates it into the air, and communication is carried out with respect to the electronic key (not shown) which is possessed by a user such as a vehicle driver or the like.

The base unit 30 is a resin-made member in which an approximately cylindrical winding-axis portion 36 which houses the core 46 and a head portion 34 which holds the antenna terminal 44 and the capacitor (not shown) are formed integrally. It should be noted that the wording of "the antenna body 40 is provided at the base unit 30" means that the base unit 30 constitutes the antenna body 40 together with the core 46, the coil 42 and the like. The core 46 of this exemplified embodiment forms a bar shape which has an approximately rectangular cross section and which extends toward the Z-direction, but there is no limitation in particular for the cross-sectional shape and the whole shape of the core 46. The base unit 30 is composed of an electrically non-conductive material and more specifically, is composed of a resin material. The base unit 30 is a unit which is formed by insert-molding a pair of antenna terminals 44 composed of a metal material and a plurality of binding terminals 48 by using a resin material. The antenna terminals 44 and the binding terminals 48 are connected separately. Both the terminals of the coil 42 are bound to the pair of binding terminals 48 respectively.

At the periphery of the winding-axis portion 36, there are formed protruding portions 38 which restrict winding displacements of the coil 42 wound there-around. There are formed a plurality of protruding portions 38 by being separated at a plurality of positions toward the winding-axis direction (Z-direction) of the winding-axis portion 36. The coil 42 is bound to the binding terminals 48 under the condition of being wound-around in multi layers at the periphery of the winding-axis portion 36 and between the protruding portions 38 each other.

The connector unit 10 is composed of a resin material and is used by being mounted on the head portion 34 of the base unit 30. In case of using the antenna coil device 100 for a vehicle electronic key system, there sometimes exists a case in which the configuration of the connector in the external circuit becomes different for every vehicle type. The connector unit 10 is exclusively designed & fabricated to have a configuration in conformity with each vehicle type. On the other hand, the base unit 30 and the antenna characteristic & configuration of the antenna body 40 can be designed & fabricated in common regardless of the vehicle type.

Figure 6:
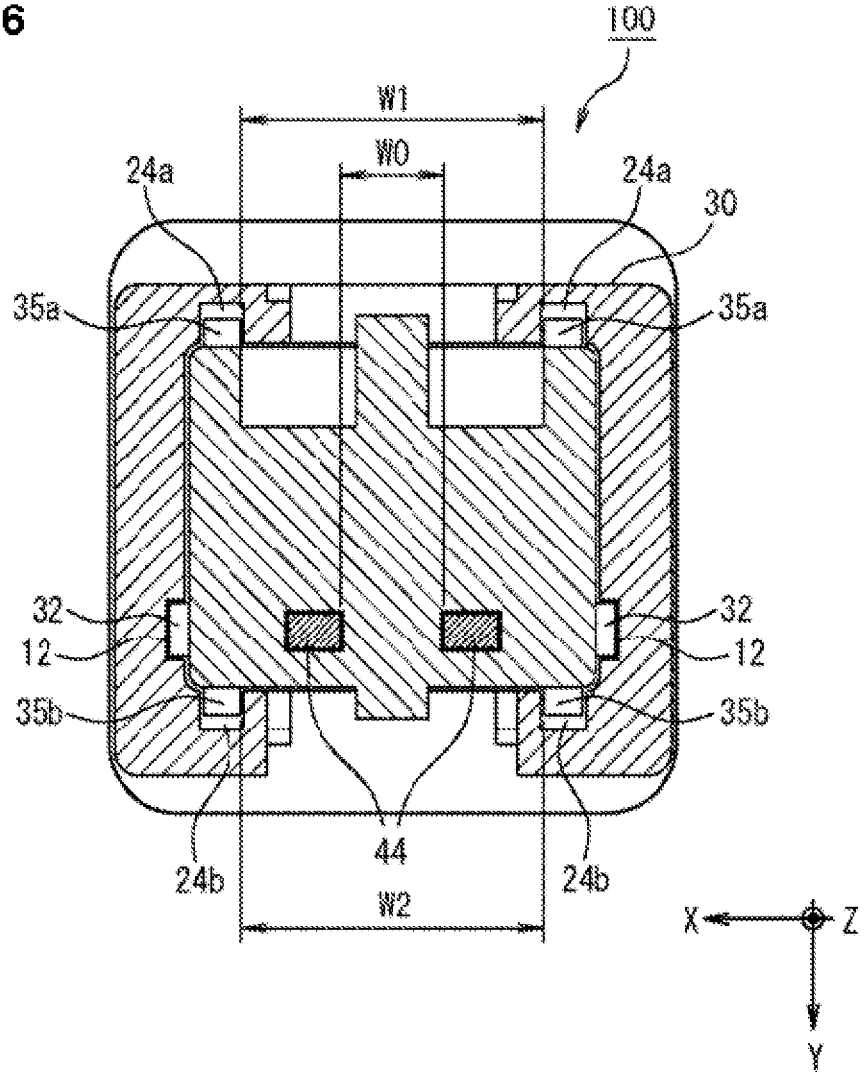
FIG. 6 is a schematic view showing a horizontal cross section in a fitted state between the connector fitting portion and the base fitting portion.

At the base unit 30, there are provided a pair of antenna terminals 44 connected to the coil 42 by being protruded toward the plug-in direction of the connector unit 10. The plug-in direction of the connector unit 10 of this exemplified embodiment is Z-direction. As shown in FIG. 3 and FIG. 6 (mentioned later), the base fitting portion 32 is formed on an extended line of the aligning direction (X-direction in this exemplified embodiment) of the pair of antenna terminals 44. The antenna body 40 is positioned toward the intersecting direction of this aligning direction with respect to the connector unit 10.

Here, the wording of "the base fitting portion 32 is formed on an extended line of the aligning direction of the pair of antenna terminals 44" means that the plane containing the respective center lines of the pair of antenna terminals 44 intersects with at least a portion of the base fitting portion 32. In addition, the wording of the antenna body 40 is positioned toward a certain direction with respect to the connector unit 10" means that the coupling portion (antenna terminal 44 in this exemplified embodiment) between the antenna body 40 and the connector unit 10 is restricted for the movement thereof toward the aforesaid direction with respect to the connector unit 10 without backlash or looseness and also without being displaced flexibly. In this exemplified embodiment, the antenna terminals 44 are fixed on the head portion 34 of the base unit 30, and the base unit 30 is fitted with & fixed to the connector unit 10 through the base fitting portion 32 and the connector fitting portion 12. Consequently, the antenna terminal 44 is positioned with respect to the connector unit 10.

The base fitting portion 32 has a rectangular parallelepiped shape and is chamfered smoothly for the distal side (−Z side) thereof. The protruding directions (±X-directions) of the base fitting portions 32 are referred to as thickness directions and the orthogonal directions (±Y-directions) thereof are referred to as width directions. The width dimension of the base fitting portion 32 is larger than the thickness dimension thereof.

As shown in FIG. 6 (which is mentioned later), the base fitting portions 32 are formed on the both sides of the extended line in the aligning direction of the pair of antenna terminals 44. On the inside of the plane (XY plane) perpendicular to the winding axis, a linear line (X-direction linear line), which connects the centers of the pair of antenna terminals 44 each other, passes the centers of the width dimensions of the pair of base fitting portions 32. In addition, the width dimension (Y dimension) of the base fitting portion 32 is larger than the Y dimension of the antenna terminal 44. More specifically, the antenna terminals 44 of this exemplified embodiment are contained in the inside of a belt-shaped area which connects the formation areas of the pair of base fitting portions 32 each other and which extends in the X-direction. Thus, by fitting the pair of base fitting portions 32 with the connector fitting portions 12 and by positioning the base unit 30 with respect to the connector unit 10, it becomes a state in which also the antenna terminals 44 positioned in the inside thereof will be positioned with high positioning accuracy with respect to the connector unit 10.

The head portion 34 of this exemplified embodiment forms a rectangular-plate shape extending within the XY plane which is perpendicular to the plug-in direction (Z-direction) of the connector unit 10. For the head portion 34, the antenna terminals 44 are protruded by passing there-through toward the direction perpendicular to the surface. At the periphery of the rectangular head portion 34, the base fitting portions 32 are formed by being protruded outward from both the side edges in the aligning direction (X-direction) of the pair of antenna terminals 44. At the periphery of the head portion 34, there are additionally formed second fitting portions 35 (35*a*, 35*b*) by being protruded outward from both the side edges in the intersecting direction (orthogonal direction "±Y-directions" in this exemplified embodiment) with respect to the aligning direction (X-direction) of the pair of antenna terminals 44. The second fitting portions 35 are positions for positioning the head portion 34 with respect to the connector unit 10 in the aligning direction of the pair of antenna terminals 44.

As shown in FIG. 4, for the connector unit 10 of this exemplified embodiment, a cylindrical connector-acceptor 20 which is opened toward the distal side (−Z side) and a base-acceptor 22 which is opened toward the rear end side (+Z side) are formed integrally. Into the connector-acceptor 20, there will be inserted the connector of the external circuit. Into the base-acceptor 22, there will be inserted the head portion 34 of the base unit 30.

The connector unit 10 is provided with a bottomed opening portion 14 for mounting the base unit 30. Through-holes 18 through which the antenna terminals 44 are inserted are formed at the bottom portion 16 of the opening portion 14. The connector (not shown) of the external circuit is plugged-in on the −Z side for the connector unit 10. The opening portion 14 is formed with openings on the opposite side hereof (+Z side).

For the connector unit 10, there are formed the connector fitting portions 12 for being fitted with the base fitting portions 32 of the base unit 30 in a concave and convex fashion. In this exemplified embodiment, there is illustrated a case in which the base fitting portions 32 are convex sides and the connector fitting portions 12 are concave sides, but it is not limited by this configuration.

By inserting and mounting the base unit 30 toward the depth direction of the opening portion 14, the connector fitting portions 12 and the base fitting portions 32 are fitted with each other.

The opening portion 14 has a rectangular concave-shape corresponding to the rectangular head portion 34 of the base unit 30. At the periphery of the opening portion 14, the pair of connector fitting portions 12 are formed integrally with the through-holes 18 by being projected respectively toward the aligning direction (X-direction) of the through-holes 18. In addition, at the periphery of the opening portion 14, the second fitting portions 24 (24*a*, 24*b*) are formed integrally so as to be projected toward both the sides of the intersecting direction (orthogonal directions "±Y-directions" in this exemplified embodiment) with respect to the aligning direction of the through-holes 18.

The base fitting portions 32 are formed integrally with the base unit 30 (see FIG. 3) and also, the connector fitting portions 12 are formed integrally with the connector unit 10 (see FIG. 4).

Figure 5A:
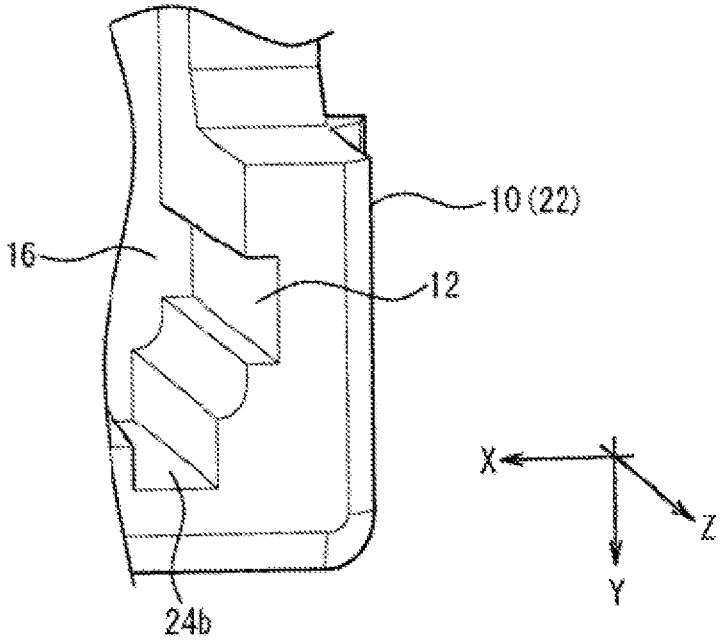
FIG. 5A is a perspective view showing a connector fitting portion.
Figure 5B:
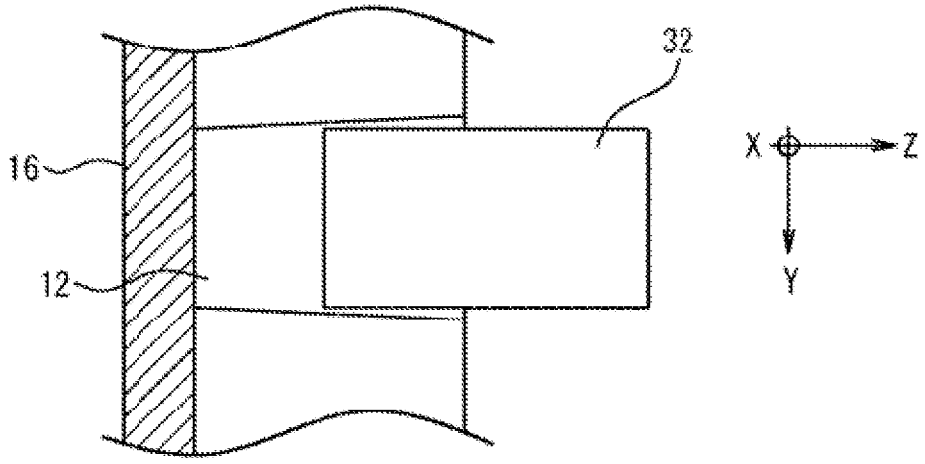
FIG. 5B is an explanatory view showing a state in which the base fitting portion is inserted into the connector fitting portion.

FIG. 5A is a perspective view showing the connector fitting portion 12 and this is a partially enlarged view of the connector unit 10 shown in FIG. 4. FIG. 5B is an explanatory view showing a state in which the base fitting portion 32 is inserted into the connector fitting portion 12.

At least one of the connector fitting portion 12 and the base fitting portion 32 is constituted to have symmetric taper shapes on both sides thereof, each of which is reduced in diameter or enlarged in diameter toward the depth direction of the opening portion 14. Then, the taper ratios of the connector fitting portion 12 and the base fitting portion 32 are different from each other. Here, the wording of "the taper ratio is different" includes a configuration in which the taper ratio of one of the connector fitting portion 12 and the base fitting portion 32 is zero. In addition, the above wording includes a configuration in which the taper directions of the connector fitting portion 12 and the base fitting portion 32 are opposite to each other, that is, a configuration in which one is reduced in diameter toward the depth direction and the other is enlarged in diameter toward the depth direction.

In this exemplified embodiment, there is illustrated a case in which the base fitting portion 32 is the convex portion and the connector fitting portion 12 is the concave portion. The connector fitting portion 12 of this exemplified embodiment is constituted to have taper shapes in each of which the width dimension (Y dimension) decreases toward the depth direction ((−Z)-direction) of the opening portion 14. On the other hand, with regard to the base fitting portion 32, the width dimensions thereof are constituted to have uniform and straight shapes (taper ratio is zero). As shown in FIG. 5, by maintaining the operation of inserting the base fitting portion 32 with respect to the connector fitting portion 12, the distal portion (end portion on the −Z side) of the base fitting portion 32 is pressure-contacted to the inner wall surface of the connector fitting portion 12. The connector fitting portion 12 is constituted to have symmetric taper shapes on both sides toward the width direction. In other words, inclinations of the inner wall surfaces of the connector fitting portion 12 are symmetric with respect to the width center. For this reason, even if a machining error occurs for the width dimension of the base fitting portion 32 or even if individual differences of productions occur for the insertion depths of the base fitting portion 32 with respect to the connector fitting portion 12, it is possible, by merely inserting the base fitting portion 32 into the connector fitting portion 12, to obtain a configuration in which the base fitting portion 32 and the connector fitting portion 12 will be centered automatically toward the width direction (Y-direction). Therefore, it is possible to heighten the positioning accuracy relating to the Y-direction of the protruded position of the antenna terminal 44 with respect to the connector unit 10.

The opening dimension of the through-hole 18 is larger than the cross-sectional dimension of the antenna terminal 44 and the antenna terminal 44 is loosely inserted with respect to the through-hole 18. By a configuration in which the periphery (bottom portion 16) of the through-hole 18 does not interfere with the antenna terminal 44, a phenomenon in which the positioning accuracy of the antenna terminal 44 will be reduced is prevented depending on the machining accuracy of the through-hole 18.

FIG. 6 is a schematic view showing a horizontal cross section in a fitted state between the connector fitting portion 12 and the base fitting portion 32. The cross section of the antenna coil device 100 which is obtained by being cut along the XY plane is referred to as a horizontal cross section.

The connector unit 10 and the base unit 30 are provided with second fitting portions 24 (24*a*, 24*b*) and 35 (35*a*, 35*b*) respectively which are formed by concaves and convexes toward the intersecting direction with respect to the aligning direction of the pair of antenna terminals 44 and which are fitted with each other. By fitting the second fitting portions 24 and 35 each other, the antenna body 40 is positioned in the aligning direction with respect to the connector unit 10. Thus, in the antenna coil device 100 of this exemplified embodiment, the antenna terminals 44 of the antenna body 40 are positioned in both of the aligning direction of the antenna terminals 44 and the intersecting direction thereof with respect to the connector unit 10. Consequently, the external circuit (not shown) and the antenna terminals 44 are connected electrically and mechanically in a very stable state through the connector unit 10.

In the antenna coil device 100 of this exemplified embodiment, there is illustrated a case in which the second fitting portions 24 (24*a*, 24*b*) of the connector unit 10 are concave portions and the second fitting portions 35 (35*a*, 35*b*) of the base unit 30 are convex portions.

There is no limitation in particular for the number of the second fitting portions 24 and 35. It is allowed to employ one piece for each and it is also allowed to employ a plurality of pieces for each. It is also allowed to employ a configuration in which a plurality of convex portions are fitted with a single concave portion. In this exemplified embodiment, there is illustrated an embodiment in which two respective pieces of second fitting portions 24 and 35 are formed on both sides of the ±Y-directions by sandwiching the antenna terminals 44.

As shown in FIG. 6, for the base unit 30, there are arranged two sets of second fitting portions 35 (35*a*-35*a*, 35*b*-35*b*) along the aligning direction (X-direction) of the pair of antenna terminals 44. Each of the two sets of second fitting portions 35 (35*a*-35*a*, 35*b*-35*b*) are arranged by being separated from each other with wider distance than that of the pair of antenna terminals 44.

For the base unit 30, there are formed the second fitting portions 35 by two pairs of pieces respectively on both sides of the intersecting direction by sandwiching the antenna terminals 44. More specifically, the distance W1 between the second fitting portions 35*a*-35*a* is wider than the distance W0 between the pair of antenna terminals 44. In addition, the distance W2 between the second fitting portions 35*b*-35*b* is also wider than the distance W0 between the pair of antenna terminals 44. It should be noted that the distance between the pair of second fitting portions 35 each other or between the pair of antenna terminals 44 each other means the distance between the adjacent edges with respect to the aligning direction (X-direction) of the antenna terminals 44. In a case in which the second fitting portions 35 are provided by a plurality of sets (35*a*-35*a*, 35*b*-35*b*) as in the case of this exemplified embodiment, the wording of "the pair of second fitting portions 35 are arranged by being separated from each other with wider distance than that of the pair of antenna terminals 44" means that at least the distance between the pair of second fitting portions 35 (35*a* or 35*b*) is wider than the distance between the antenna terminals 44 each other.

In this exemplified embodiment, the distance W1 between the second fitting portions 35*a*-35*a* and the distance W2 between the second fitting portions 35*b*-35*b* are equal to each other. Based on the configuration as this exemplified embodiment in which each of the two sets of the second fitting portions 35 are disposed by being separated from each other with wider distance than that of the pair of antenna terminals 44, it is possible to form the pair of antenna terminals 44 by a still higher machining accuracy than that of the second fitting portions 35.

Figure 7:
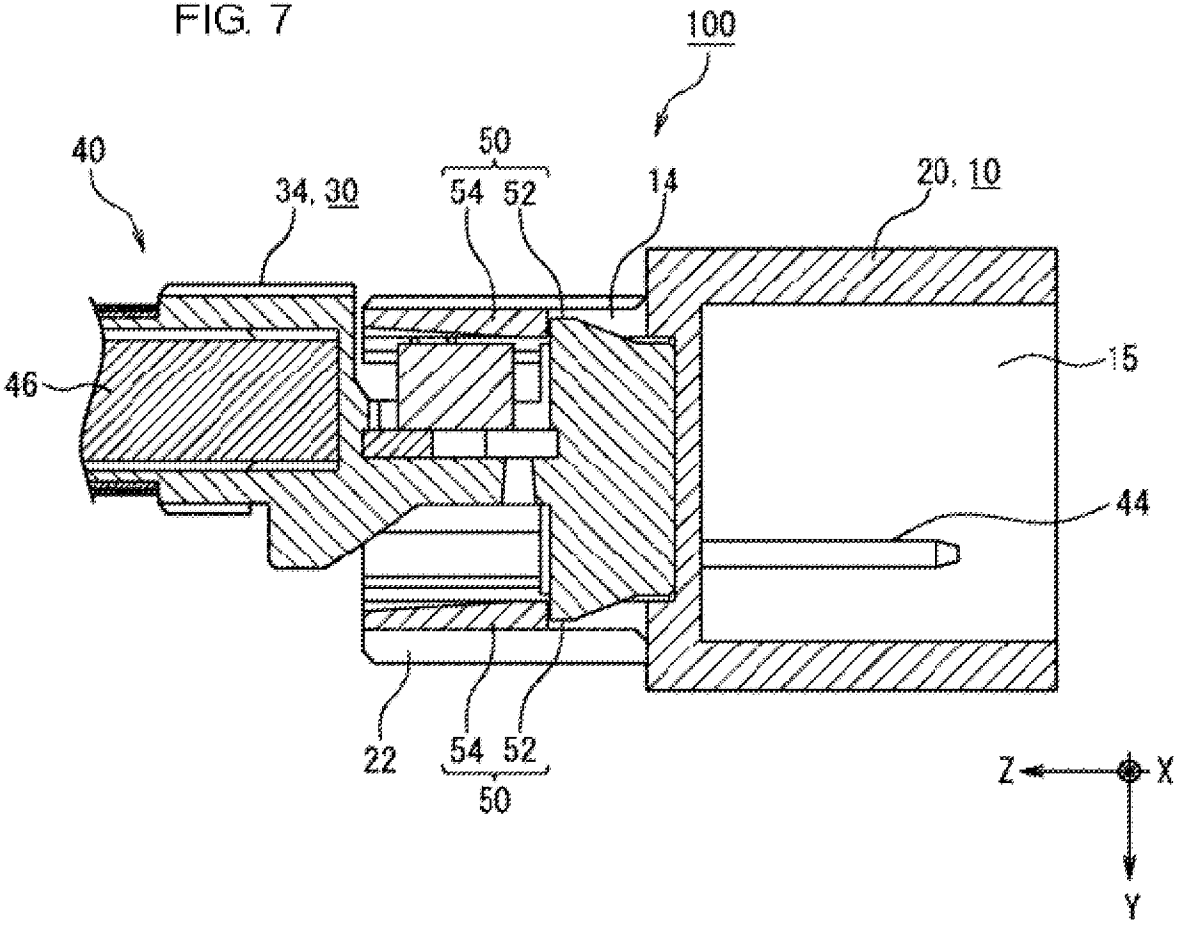
FIG. 7 is a schematic view showing a vertical cross section in a fitted state between the connector unit and the base unit.

FIG. 7 is a schematic view showing a vertical cross section in a fitted state between the connector unit 10 and the base unit 30. The cross section of the antenna coil device 100 which is obtained by being cut along the Z-axis is referred to as a vertical cross section.

The antenna coil device 100 is provided with lock mechanisms 50 for engaging the connector unit 10 and the base unit 30 by being deformed in a protruding and retracting fashion toward the intersecting direction (Y-direction) with respect to the aligning direction (X-direction) of the pair of antenna terminals 44.

As shown in FIG. 2 and FIG. 7, the lock mechanisms 50 are constituted by stopper claws 52 formed on the head portion 34 of the base unit 30 and restricting pieces 54 formed on the base-acceptor 22 of the connector unit 10. The stopper claws 52 are formed by being protruded toward the outward in the circumferential direction (in the ±Y-directions for this exemplified embodiment) from the head portion 34. With regard to the stopper claw 52, the front end side thereof (−Z side) is inclined and the rear end side thereof (+Z side) forms a stood-up fold-back portion.

The restricting pieces 54 are the positions which are elastically deformed toward the same direction (Y-direction) in a freely protruding and retracting fashion. The restricting pieces 54 have tongue-piece shapes extending toward the depth direction ((−Z)-direction) of the opening portion 14 of the connector unit 10 and they are formed integrally with the base-acceptor 22. When inserting the head portion 34 into the base-acceptor 22, the stopper claws 52 proceed into the opening portion 14 while pushing up the restricting pieces 54. When the head portions 34 are sufficiently inserted as far as the depth at which the stopper claws 52 go beyond the restricting pieces 54, the restricting pieces 54 are engaged with the rear end sides of the stopper claws 52 by being restored elastically. Thus, the returns of the stopper claws 52 are restricted and the head portion 34 (the base unit 30) is prevented from being dropped out from the opening portion 14 of the connector unit 10.

It is allowed for the lock mechanism 50 (the stopper claw 52 and the restricting piece 54) to be provided at one place or to be provided at a plurality of places. In this exemplified embodiment, the lock mechanisms are provided at two places facing to each other (on the ±Y sides) within the antenna coil device 100. Thus, the antenna body 40 is stably fixed with respect to the connector unit 10.

It should be noted that the present invention is not to be limited by the exemplified embodiment mentioned above and that the present invention also includes any embodiments of various modifications, improvements and the like so long as achieving the object of the present invention.

In the abovementioned exemplified embodiment, there was illustrated a configuration in which the antenna terminals 44 are formed in bar shapes having uniform thicknesses and are loosely inserted into the through-holes 18, but the shapes are not limited to these configurations. It is allowed for the antenna terminal 44 to be provided with a thick diameter portion thereon and to be fitted with the bottom portion 16 (the through-hole 18) of the connector unit 10.

In addition, in the abovementioned exemplified embodiment, there was illustrated an embodiment in which the connector fitting portion 12 and the base fitting portion 32 are formed in taper shapes which are reduced in diameter merely toward the width direction (Y-direction), but instead of this configuration, it is allowed to employ taper shapes in which the protruded thickness and the depth are reduced gradually in the depth direction (Z-direction).

It is not necessary for the various constituent elements of the antenna coil device of the present invention to be individually separated entities, wherein except a case of clearly specifying a single member or a separate member, it is allowed to employ a configuration in which a plurality of constituent elements are to be formed as one piece of member, to employ a configuration in which one constituent element is formed by a plurality of members, to employ a configuration in which a certain constituent element is a portion of another constituent element, to employ a configuration in which a portion of a certain constituent element and a portion of another constituent element are overlapped, and the like.

The abovementioned exemplified embodiment of the present invention covers the following technical ideas.

(1) An antenna coil device including: a connector unit mounted with a connector of an external circuit detachably by being plugged-in; and a base unit provided with an antenna body including a coil, in which the connector unit and the base unit are constituted by separate members and are used by being combined integrally each other, wherein for the connector unit and the base unit, there are formed a connector fitting portion and a base fitting portion which are formed with a concave and a convex in a direction intersecting with respect to the plug-in direction of the connector unit, and by fitting the connector fitting portion and the base fitting portion, the connector unit and the base unit are combined in a state in which the antenna body is positioned with respect to the connector unit.

(2) The antenna coil device described in the abovementioned item (1), wherein in the base unit, there are provided a pair of antenna terminals connected to the coil by protruding toward the plug-in direction, and the base fitting portion is formed on an extended line in the aligning direction of the pair of antenna terminals in which the antenna body is positioned toward the intersecting direction of the aligning direction with respect to the connector unit.

(3) The antenna coil device described in the abovementioned item (2), wherein the connector unit includes a bottomed opening portion for mounting the base unit and there is formed a through-hole for inserting the antenna terminal at the bottom portion of the opening portion.

(4) The antenna coil device described in the abovementioned item (3), wherein the connector fitting portion and the base fitting portion are fitted by inserting and mounting the base unit in the depth direction of the opening portion.

(5) The antenna coil device described in the abovementioned item (4), wherein at least one of the connector fitting portion and the base fitting portion has symmetric taper shapes on both sides, which are reduced in diameters or enlarged in diameters toward the depth direction, and also, the taper ratios thereof are different from each other.

(6) The antenna coil device described in any one of the abovementioned items (2) to (5), wherein the connector unit and the base unit respectively include second fitting portions each of which is formed with a concave and a convex in the intersecting direction with respect to the aligning direction of the pair of antenna terminals and which are fitted with each other, and the antenna body is positioned in the aligning direction with respect to the connector unit by fitting the second fitting portions with each other.

(7) The antenna coil device described in the abovementioned item (6), wherein in the base unit, the pair of second fitting portions are disposed by being apart with wider width than that of the pair of antenna terminals along the aligning direction of the pair of antenna terminals.

(8) The antenna coil device described in the abovementioned item (7), wherein in the base unit, the second fitting portion is formed with a pair of pieces respectively on both sides of the intersecting direction by sandwiching the antenna terminal.

(9) The antenna coil device described in any one of the abovementioned items (2) to (8), wherein there is provided with a lock mechanism for engaging the connector unit and the base unit by being deformed in a protruding and retracting fashion toward the intersecting direction with respect to the aligning direction of the pair of antenna terminals.

(10) The antenna coil device described in any one of the abovementioned items (1) to (9), wherein the base fitting portion is formed integrally with the base unit, and the connector fitting portion is formed integrally with the connector unit.

INDUSTRIAL ADVANTAGE

According to the antenna coil device 100 explained above, it is possible to heighten the electric coupling-reliability between the connector unit 10 and the antenna terminals 44. For this reason, in a case in which the antenna coil device 100 is used for a vehicle electronic key system, there occurs no inoperative or malfunction. In a case in which malfunction once occurs, it becomes a situation in which the door of the vehicle will be opened and a risk of robbery or the like will occur, but according to the antenna coil device 100, it is possible to reduce the risk thereof.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An antenna coil device comprising: a connector unit mounted with a connector of an external circuit detachably by being plugged-in; and a base unit provided with an antenna body including a coil, in which the connector unit and the base unit are constituted by separate members and are used by being combined integrally each other, wherein for the connector unit and the base unit, there are formed a connector fitting portion and a base fitting portion which are formed with a concave and a convex in a direction intersecting with respect to the plug-in direction of the connector unit, and by fitting the connector fitting portion and the base fitting portion, the connector unit and the base unit are combined in a state in which the antenna body is positioned with respect to the connector unit;

wherein the connector unit comprises a bottomed opening portion for mounting the base unit; and the connector fitting portion and the base fitting portion are fitted by inserting and mounting the base unit in the depth direction of the opening portion.

2. The antenna coil device according to claim 1, wherein in the base unit, there are provided a pair of antenna terminals connected to the coil by protruding toward the plug-in direction, and the base fitting portion is formed on an extended line in the aligning direction of the pair of antenna terminals in which the antenna body is positioned toward the intersecting direction of the aligning direction with respect to the connector unit.

3. The antenna coil device according to claim 2, wherein there is formed a through-hole for inserting the antenna terminal at the bottom portion of the opening portion.

4. The antenna coil device according to claim 2, wherein the connector unit and the base unit respectively include second fitting portions each of which is formed with a concave and a convex in the intersecting direction with respect to the aligning direction of the pair of antenna terminals and which are fitted with each other, and the antenna body is positioned in the aligning direction with respect to the connector unit by fitting the second fitting portions with each other.

5. The antenna coil device according to claim 4, wherein in the base unit, the pair of second fitting portions are disposed by being apart with wider width than that of the pair of antenna terminals along the aligning direction of the pair of antenna terminals.

6. The antenna coil device according to claim 5, wherein in the base unit, the second fitting portion is formed with a pair of pieces respectively on both sides of the intersecting direction by sandwiching the antenna terminal.

7. The antenna coil device according to claim 2, wherein there is provided with a lock mechanism for engaging the connector unit and the base unit by being deformed in a protruding and retracting fashion toward the intersecting direction with respect to the aligning direction of the pair of antenna terminals.

8. The antenna coil device according to claim 1, wherein at least one of the connector fitting portion and the base fitting portion has symmetric taper shapes on both sides, which are reduced in diameters or enlarged in diameters toward the depth direction, and also, the taper ratios thereof are different from each other.

9. The antenna coil device according to claim 1, wherein the base fitting portion is formed integrally with the base unit, and the connector fitting portion is formed integrally with the connector unit.

* * * * *